United States Patent [19]

Lehinant et al.

[11] 3,990,846

[45] Nov. 9, 1976

[54] PROCESS FOR THE CONTINUOUS DYEING AND PRINTING OF PIECE GOODS

[75] Inventors: Armand Lehinant, Offenbach am Main; Joachim Walter Lehmann, Kelkheim, Taunus; Hans-Peter Maier, Sulzbach, Taunus, all of Germany

[73] Assignee: Hoechst Aktiengesellschaft, Frankfurt am Main, Germany

[22] Filed: Aug. 6, 1974

[21] Appl. No.: 495,294

[30] Foreign Application Priority Data

Aug. 8, 1973 Germany ..... 2340045

[52] U.S. Cl. ..... 8/163; 8/1 B; 8/1 E; 8/1 D; 8/21 B; 8/54.2

[51] Int. Cl.[2] ..... D06P 1/38

[58] Field of Search ..... 8/163, 1 B, 1 E, 1 D

[56] References Cited

UNITED STATES PATENTS

| | | | |
|---|---|---|---|
| 3,185,538 | 5/1965 | Voltz | 8/55 |
| 3,326,887 | 6/1967 | Riat | 260/153 |
| 3,338,660 | 8/1967 | Biedermann | 8/54 |

FOREIGN PATENTS OR APPLICATIONS

| | | | |
|---|---|---|---|
| 611,482 | 12/1960 | Canada | 8/1 S |

*Primary Examiner*—Joseph L. Schofer
*Assistant Examiner*—A. L. Clingman
*Attorney, Agent, or Firm*—Curtis, Morris & Safford

[57] ABSTRACT

Process for the continuous dyeing and printing of piece goods made of synthetic polyamide fibers, preferably blended with cellulosic fibers, using reactive dyestuffs according to a thermofixing method, by applying onto the textile material an aqueous padding liquor or a printing paste, which has been weakly acidified by means of a buffer system of acetic acid and an alkali metal acetate and which contains a fiber-reactive dyestuff whose reactive groups have reversibly been masked by reaction with an alkali metal salt of an N-alkyl-aminoalkyl-sulfonic acid, and after drying of the material fixing the dyestuff on the two fiber components by means of dry heat.

3 Claims, No Drawings

PROCESS FOR THE CONTINUOUS DYEING AND PRINTING OF PIECE GOODS

The present invention relates to a process for the continuous dyeing and printing of piece goods made of synthetic polyamide fibers, preferably blended with cellulosic fibers.

Processes for the printing and pad-dyeing of cellulosic fibers using reactive dyes in the presence of alkaline agents and subsequent thermofixing of the dyes by means of dry heat, steaming or a dwell process at room temperature have been known for a long time and are widely used in practice.

The periodical "Textil-Praxis", No. 7, pages 523 et seq., for example, discloses methods, according to which reactive dyes on a vinylsulfone basis can be thermofixed by means of dry heat on cellulosic fibers in the presence of sodium carbonate (or sodium carbonate and sodium borate) as alkaline agent at temperatures of from 120° to 190° C or at 210° C using sodium hydrogenocarbonate as an alkali-yielding agent and sodium borate. Mention is therein made of a possible yellowing of the cellulosic fibers caused by the simultaneous action of alkaline agents and high temperature, although the addition of sodium borate reduces this tendency.

German patent specification No. 1,280,809 discloses a process for the thermofixation of hydroxyethyl-sulfone and hydroxyethyl-sulfonylamino dyes on cellulosic fibers in the presence of alkalis at temperatures above 140° C. Suitable alkalis or alkali-yielding agents mentioned in that patent are alkali metal or alkaline earth metal hydroxides, alkali metal carbonates or bicarbonates, orthophosphates, borates, alkali metal salts of trihalocarboxylic acids or mixtures of these alkalis with one another. In that process, too, yellowing of the cellulosic fibers is possible. Another process, wherein inter alia vinylsulfone dyes are applied onto synthetic polyamide fibers with the aid of an acid-binding agent according to an exhaust method at boiling temperature and below the neutral point (up to pH 7), is disclosed in German Offenlegungsschrift No. 2,104,348.

Swiss Patent specification N. 419,046 claims a process, wherein inter alia N-alkylsulfonyl-N-alkylamino-ethylsulfone dyes are fixed on cellulosic fibers in the presence of substances having an alkaline action (the same as mentioned above), at elevated temperatures. In this case, fixation is generally brought about by means of a steaming process by dry heat conditions (8 minutes at 140° C) are also mentioned. These conditions, however, do not admit a fully continuous operation, for which shorter fixing times (60 – 90 seconds) and higher temperatures are usually required. At a temperature of 140° C, however, complete fixing of the dyes within such a short fixing period is not possible.

German Offenlegungsschrift No. 1,619,471 relates to a process for the printing and padding of polyester and cellulose fiber blends, wherein reactive and disperse dyes are applied from neutral liquors or printing pastes and fixed by the action of alkali-yielding agents and by steaming.

German Offenlegungsschrift No. 1,916,627 relates to the printing and padding of polyamide fibers, wherein reactive dyes are fixed by steaming in the presence of alkalis or alkali-yielding agents. This process, however, requires an after-wash by means of alkaline agents.

It has now been found that piece goods made of synthetic polyamide fibers, preferably blended with cellulosic fibers, can be continuously dyed and printed using reactive dyestuffs according to a thermofixing method, the two fiber portions being dyed in the same depth of color, resp. tone-in-tone, by applying onto these goods an aqueous padding liquor or a printing paste, which is weakly acidified by means of a buffer system of acetic acid and an alkali metal acetate and which contains such a fiber-reactive dyestuff, whose reactive groups have reversibly been masked by reaction with an alkali metal salt of an N-alkyl-amino-alkylsulfonic acid, preferably the sodium salt of N-methyltaurine, and then, after the goods have been dried, fixing the dyestuff on the two fiber components by means of dry heat.

According to the process of the invention, the reaction product of methyltaurine and the reactive dyestuff is again decomposed during the thermal treatment into its original components, whereupon the addition reaction of the reactive dyestuff split-product with the $—NH_2$ and —OH groups of the fiber portions can take place. The padding liquor or printing paste contains, in addition to the dissolved methyltaurino reactive dyestuff, a weakly acidic buffer solution of 2 to 4 ml/l of acetic acid (60 %) and 10 g/l of crystallized sodium acetate (pH 5.8). Where required, conventional wetting agents may also be added to the dyestuff composition. In some cases, further additives, such as polyalkylene glycols having a medium molecular weight (for example, of about 600) or similar hydrotropic substances are of advantage to the dyestuff yield.

After the padding or printing operation, the textile material is generally dried in the usual manner (for example on a hotflue, a tenter frame or drying cylinders) at temperatures of about 100° C and then exposed to dry heat of 190 to 210° C for 60 to 120 seconds (depending on the polyamide fiber type). If the thermofixing operation is performed without intermediate drying, the fixation time has to be prolonged by about 30 seconds. Conditions are, of course, different if fixation is performed using perforated drums. In this case, drying and fixing times may be shorter. The dyeings and prints produced are aftertreated by rinsing them — mostly at open width — with hot water and soaping them in a manner usual for this type of goods, for example in an aqueous liquor using non ionic detergents (0.5 g/l) in a neutral medium and for a short time at boiling temperature.

The methyltaurino dyestuffs used for the present invention have originally been developed (DOS No. 2,047,832) on the basis of sulfatoethyl-sulfone reactive dyes for the dyeing of wool according to the exhaust method, that is to say for the dyeing from long liquors, and allow satisfactory level reactive dyeings to be obtained on wool, having excellent fastness to wet processing. They are prepared by reacting sulfatoethyl-sulfone dyes with N-methyl-taurine in an alkaline medium, whereby the fiber-reactive group is temporarily stabilized. According to the exhaust dyeing of wool, this reaction is an acid medium at temperatures of about 100° C is reversible, splitting the dyestuff into the vinylsulfone dyestuff and into methyltaurine. The vinylsulfone dyestuff which has already been absorbed then reacts with the amino groups of the wool, the reaction equilibrium in the acid range being shifted in favor of the reactive dyestuff form. Under these pH- and thermal conditions, the cellulosic fibers are, however, not dyed.

It is therefore surprising that the thermal conditions of the thermofixing process (60 to 120 seconds at 190° – 210° C) and the simultaneous action of a buffer solution of acetic acid and an acetate give rise to a different reaction equilibrium which, under dry heat, permits the formation of a dyestuff form capable of reacting with amino and hydroxy groups and thus a uniform dyeing both of the polyamide and cellulose portions. It is further surprising that the thermofixing process disclosed allows to use not only methyltaurino reactive dyestuffs having reactive groups which form the vinylsulfone compounds and thus give an addition reaction with the fibers but also those dyestuffs which give a substitution reaction with the fibers, for example dichloroquinoxaline or dichlorotriazine groups.

It is moreover not obvious that these methyltaurino reactive dyestuffs, that is to say a single dyestuff class, can be used according to the disclosed thermofixing process to pad and print both polyamide fibers (resp. the polyamide portion of blends) and cellulosic fibers (or portions thereof) at a uniform color depth and in almost homogenous shades (certain slight differences in shading between polyamide and cellulose are negligible). The blending ratio of polyamide to cellulosic fibers need therefore not be taken into regard.

The dyestuffs used for the production of the dyeings and prints according to this invention may be obtained by boiling the above-cited amino compounds, preferably N-methyl-taurine, in an alkaline liquor with reactive dyestuffs for 1 to 2 minutes. Suitable starting dyestuffs of this category are to be found, for example, along the series of oxazine, triphenylmethane, xanthone, nitro, acridone or phthalocyanine dyestuffs, especially of metal-free or metallized mono- or polyazo dyestuffs and of anthraquinone dyestuffs containing at least one water-solubilizing group, such as the sulfonic acid or carboxylic acid group, as well as, preferably, one or more groups $—SO_2—CH_2—CH_2—OSO_3H$.

The following Examples illustrate the invention.

EXAMPLE 1

A blended fabric made of polyamide-6,6 fibers and cellulosic spun rayon (ratio 50 : 50) was padded in a padding machine at room temperature and a liquor pick-up of 75 % (calculated on the dry weight of the material) with an aqueous liquor containing, per liter, 13.3 g of the reactive dyestuff of the formula

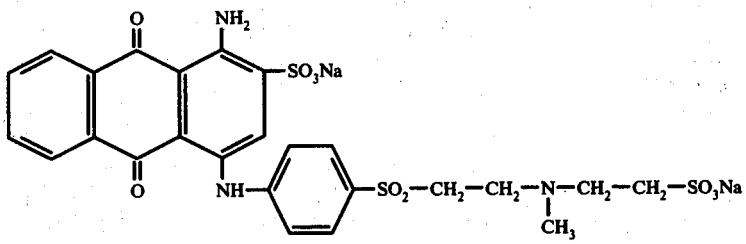

10 g of a polyethylene glycol having an average molecular weight of 600, 4 ml of acetic acid (of 60 % strength) and 10 g of crystallized sodium acetate.

The padded material was then dried at 100° C and thermosoled at 200° C for 90 seconds (dry heat).

The dyeing obtained was after-treated by rinsing it with cold and hot (70° C) water, soaping at the boil with an aqueous bath containing 0.2 g/l of the reaction product of 1 mol of nonylphenol with 10 mols of ethylene oxide, and further rinsing with water at open width.

A clear blue dyeing was obtained with shade and color depth on the two fiber portions matching very well.

Similar good results were obtained without using polyethylene glycol as mentioned above, though the dyeings might be a little lighter.

EXAMPLE 2

A dyeing was produced on a blended fabric made of polyamide fibers and cellulosic spun rayon as in Example 1 using, however, 15 g of the reactive dyestuff of the formula

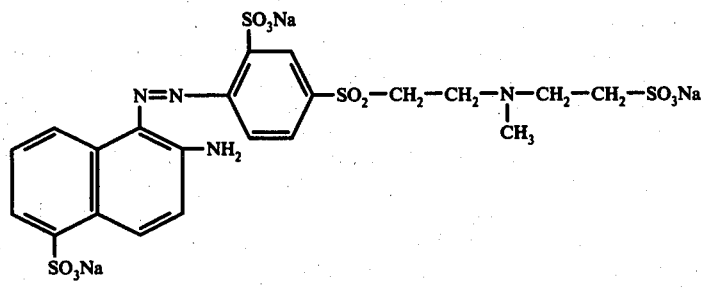

A clear red tone-in-tone dyeing was obtained on the material.

EXAMPLE 3

A blended fabric made of polyamide-6,6 fibers and mercerized cotton (ratio 50 : 50) was printed using a printing paste of the following composition:

9 g of the reactive dyestuff of the formula

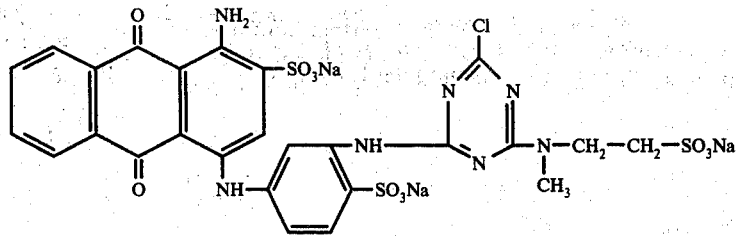

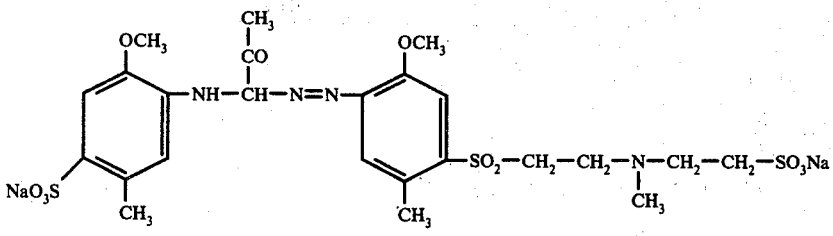

and 4 g of the reactive dyestuff of the formula

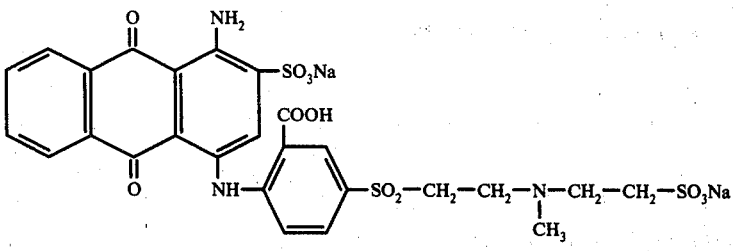

were dissolved with 15 g of polyethylene glycol (molecular weight about 600) and
150 g of hot water and stirred into
500 g of a thickening of (6 %) sodium alginate;
3 g of acetic acid (60 %) and
10 g of crystallized sodium acetate dissolved in
100 g of cold water were added, and the whole was made up with 209 g of water to 1 kilogram.

The printed material was dried and then thermosoled for 90 seconds at 200° C using dry heat.

After the usual after-wash, a homogenous green print was obtained on the two fiber portions.

EXAMPLE 4

The dyeing was produced as in Example 1 but using 14 g of the reactive dyestuff of the formula A uniform blue dyeing was obtained on the two fiber portions.

EXAMPLE 5

A blended fabric made of polyamide-6,6 fibers and mercerized cotton (ratio 50 : 50) was padded at room temperature and a liquor pick-up of 80 % in a padding machine with an aqueous liquor containing, per liter, 7.5 g of the reactive dyestuff of the formula

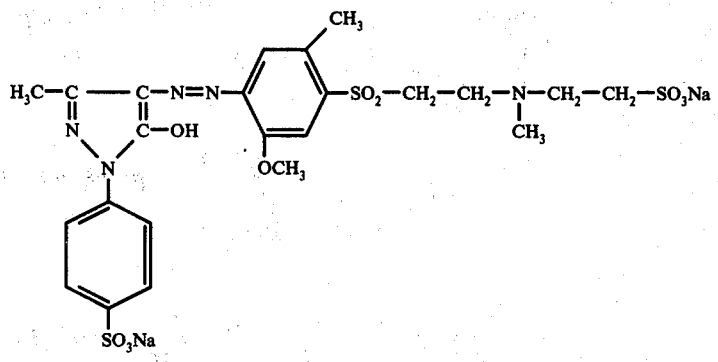

2.5 g of the reactive dyestuff of the formula

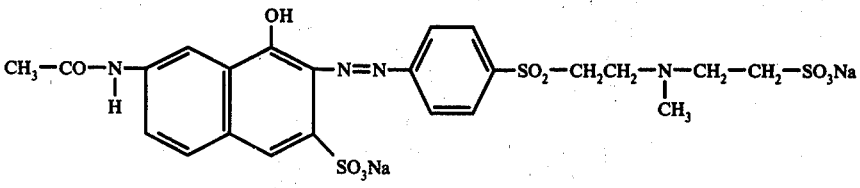

2.5 g of the reactive dyestuff of Example 1,
10 g of a polyethylene glycol of the molecular weight of about 600,
4 ml of acetic acid (60 %) and
10 g of crystallized sodium acetate.

The padded fabric was then dried at 110° C and thermosoled for 90 seconds at 200° C using dry heat.

A uniform light brown shade was obtained on the two fiber portions.

The following Table contains further formulae of methyltaurino reactive dyestuffs which could be applied according to the method disclosed in Example 1 — however, using 10 g/l each — onto blends of polyamide fibers and cotton. The indicated shades refer to the two fiber components used:
TABLE
| Example No. | Formula | Shade |
|---|---|---|
| 6 | 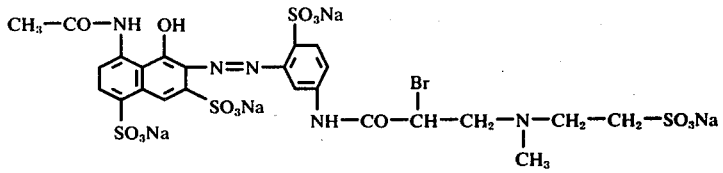 | scarlet |
| 7 | 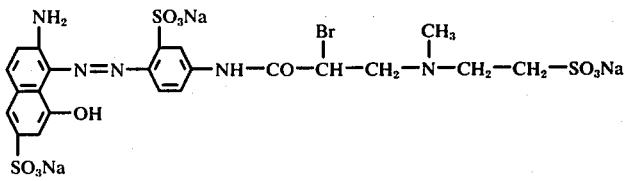 | red |
| 8 | 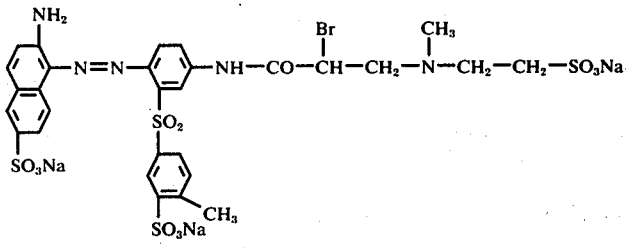 | scarlet |
| 9 | 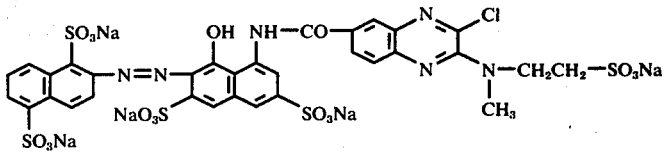 | red |
| 10 | 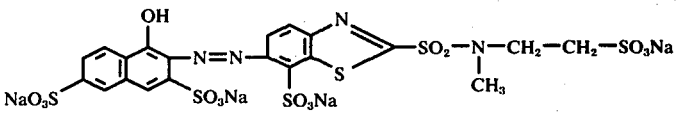 | red |
| 11 | 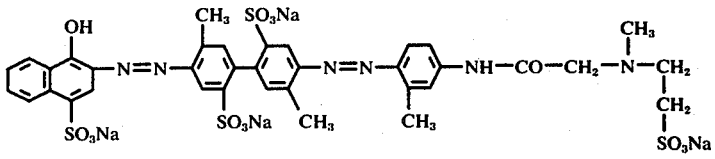 | scarlet |
| 12 | 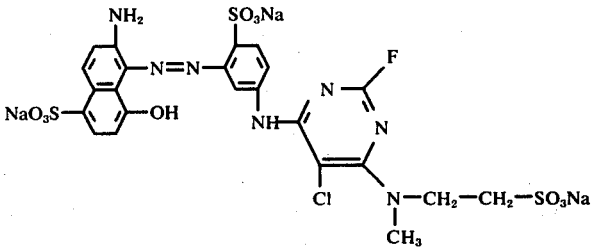 | scarlet |

TABLE-continued

| Example No. | Formula | Shade |
|---|---|---|
| 13 | 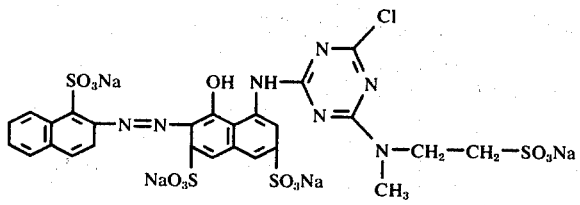 | red |
| 14 | 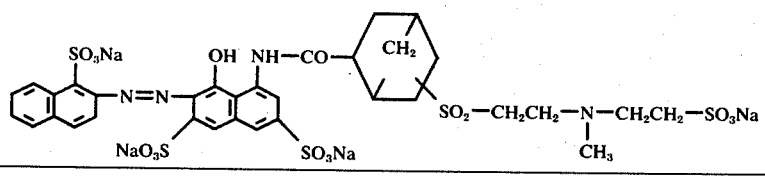 | red |

EXAMPLE 15

A knit fabric made of polyamide-6,6 fibers was padded in a padding machine at room temperature and a liquor pick-up of 65 % with an aqueous liquor containing, per liter, 6 g of the reactive dyestuff of the formula

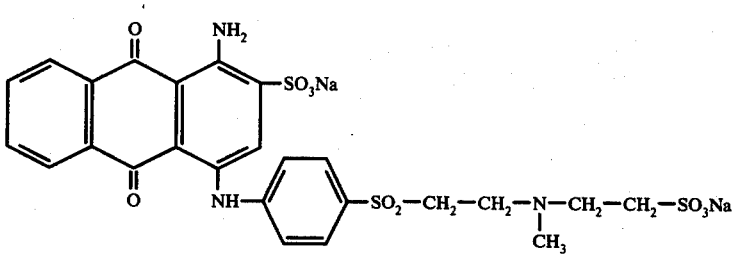

10 g of a polyethylene glycol of an average molecular weight of 600, 4 ml of acetic acid (60 %) and 10 g of crystallized sodium acetate.

The fabric was dried at 100° C and then treated with dry heat for 90 seconds at 200° C. The aftertreatment was effected as in Example 1.

A clear blue dyeing was obtained.

We claim:

1. In a process for the continuous dyeing and printing of fabrics comprising a blend of synthetic polyamide fibers and cellulose fibers, using reactive dyestuffs according to a thermofixing method, the improvement which comprises forming an aqueous padding liquor or a printing paste, weakly acidified by means of a buffer system of acetic acid and an alkali metal acetate and containing a fiber-reactive dyestuff whose reactive groups have reversibly been masked by reaction with an alkali metal salt of an N-alkyl-aminoalkylsulfonic acid, thereafter applying said padding liquor or printing paste onto said fabric, and after drying of the fabric, fixing the dyestuff on the two fiber components by means of dry heat.

2. A process of claim 1, wherein a reactive dyestuff is used which has been reacted with N-methyltaurine or the sodium salt thereof.

3. A process to claim 1, wherein a methyltaurinoethylsulfone dyestuff is used.

* * * * *